United States Patent [19]

Takeshita et al.

[11] 4,285,208

[45] Aug. 25, 1981

[54] ABSORPTION TYPE REFRIGERATING MACHINE OF HYBRID CONSTRUCTIONS

[75] Inventors: Isao Takeshita, Neyagawa; Shiro Hozumi, Sakai; Nobuhiko Wakamatsu, Kadoma, all of Japan

[73] Assignee: Matsushita Electric Industrial Co., Ltd., Kadoma, Japan

[21] Appl. No.: 140,863

[22] Filed: Apr. 16, 1980

[51] Int. Cl.[3] ..... F25B 15/00; F25B 27/00; F25B 1/00

[52] U.S. Cl. ..... 62/141; 62/238.3; 62/476; 62/235.1; 62/228

[58] Field of Search ..... 62/2, 141, 236, 238.3, 62/476, 228 R

[56] References Cited

U.S. PATENT DOCUMENTS

| | | | |
|---|---|---|---|
| 3,259,176 | 7/1966 | Rice et al. | 62/238.3 |
| 3,440,832 | 4/1969 | Aronson | 62/141 |
| 3,990,264 | 11/1976 | Patnode et al. | 62/476 |

*Primary Examiner*—Lloyd L. King

*Attorney, Agent, or Firm*—Wenderoth, Lind & Ponack

[57] ABSTRACT

According to the present invention, in a hybrid type refrigerating cycle having a compressor disposed between a refrigerant vapor generator of an absorption type refrigeration cycle and a condenser, a refrigerant reservoir is disposed after the condenser. The refrigerant liquid level inside the refrigerant reservoir is detected to properly control the start of operation or the suspending of operation of the compressor thereby to end wasteful power consumption, thus ensuring smoother operation of the refrigerating machine.

3 Claims, 1 Drawing Figure

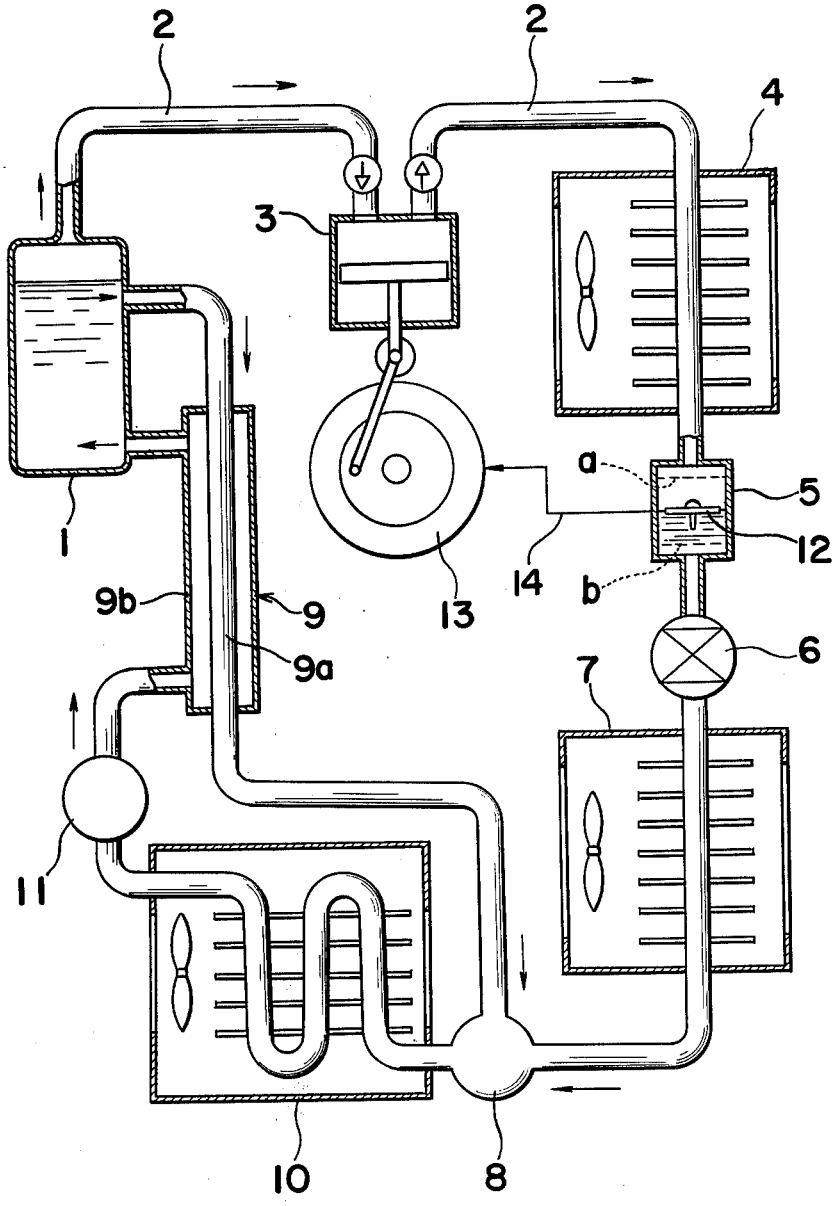
2
2
4
3
a
5
12
1
14
b
9b
9
13
6
9a
7
11
10
8

ABSORPTION TYPE REFRIGERATING MACHINE OF HYBRID CONSTRUCTIONS

The present invention relates to an absorption type refrigerating machine of hybrid construction and, more particularly, to improvements in the compressor controlling system for refrigerating machines in a hybrid type refrigeration arrangement.

The air conditioning of buildings or the refrigerating and freezing of foods are considered important to be carried out using a refrigerating cycle using solar heat, the other waste heat or the like. In the recent years, energy resources are required to be used more effectively.

The absorption type refrigerating cycle is considered useful in terms of economy for such a refrigerating cycle. However, the solar heat or the other waste heat is not always in stable supply, and the supply of the thermal energy or heat input is varied or is often suspended.

To drive the absorption type refrigerating machine using such unstable heat sources as described hereinabove, a back-up system for supplementing the deficiency is required. A separate heat source is normally provided in the hybrid connection with the refrigerating machine to supplement the solar heat or the waste heat.

In a hybrid type refrigerating machine wherein a compressor is inserted in the refrigerant gas passage from the generator of the absorption type refrigerating machine to the condenser, a method of supplementing thermal input by the driving of the compressor with electric power is used. As compared with the former back-up system, this system provided with the compressor is superior in energy economy, since the energy consumption is less for primary energy conversion.

The absorption type refrigerating machine adapted to receive within the refrigerant vapor generator the thermal input from the unsteady heat sources such as solar heat, waste heat or the like has a variable output due to variation in the amount of the thermal input and stops operation when the amount of the thermal input is small. In the hybrid type refrigerating machine, which has a compressor incorporated in the refrigerant vapor passage of the generator to supplement the thermal input, it is necessary to control the operation of the compressor in accordance with the variation in the amount of the thermal input from the heat source.

Conventionally, in this type of refrigerating machine, the compressor was manually or automatically operated when the temperature of the heat source or the temperature of the medium in the generator had become a given value or less.

The pressure of the refrigerant vapor which is produced from the generator, i.e., the suction pressure of the compressor when the compressor has been actuated at a required temperature or less is varied depending upon the temperature of the generator itself. The output of the refrigerating machine increases in proportion to the suction pressure of the compressor. Assume that the compressor in which such performance is suitable when the heat source temperature is low is hybrid-connected to the absorption type refrigerating machine, and the refrigerating performance of the compressor becomes excessive when the temperature of the generator has become slightly lower than an established value. Namely, in the on and off controlling operation for the compressor wherein the compressor is actuated when the temperature of the generator has become a given value or lower and the compressor operation is suspended when it has become a given value or higher, the satisfactory operation of the refrigerating machine cannot be effected, thus requiring a controlling operation of the compressor in accordance with temperature difference in the generator.

As the methods of controlling the output of the compressor, there are methods of varying the number of the revolutions according to the variation of the pressure on the absorption side of the compressor, of varying the effective volume of the cylinder or of returning the refrigerant from the discharge opening of the compressor to the suction side. However, these methods are not practical, since the apparatus becomes complex and expensive. Also, since the required refrigerating performance varies depending upon loads, the compressor is not required to be driven in the case where the reduced thermal input to the generator may be proper for a low load. But according to the controlling method of the conventional compressor, electric power is wasted, since the compressor is always driven in such a case. Namely, in the conventional hybrid type refrigerating machine, the temperature of the heat source or the temperature of the medium in the generator was used to control the compressor. Thus, the compressor was driven regardless of the consumption of the liquefied refrigerant in the evaporator of the refrigerating machine, and the liquefied refrigerant filled the condenser to reduce the condensing performance, thus creating an abnormally high pressure hazard therein.

Accordingly, an object of the present invention is to provide a hybrid type refrigerating machine which can eliminate the disadvantages inherent in the conventional one as described hereinabove, and which is satisfactorily operated, simple in design, compact in construction, easy to assemble and which can be manufactured at low cost.

Another object of the present invention is to provide an absorption type refrigerating machine wherein a refrigerant reservoir is provided after a condenser in the refrigeration circuit of an absorption type and the liquid level of the refrigerant located within the refrigerant reservoir is detected thereby to control the operation of the compressor.

According to the present invention, there is provided an absorption type refrigerating machine of hybrid construction wherein in an absorption type refrigerating cycle having an absorber and a generator, a compressor for compressing the refrigerant vapor disposed between said generator and a condenser in a refrigerant circuit provided with said condenser, an expansion valve and an evaporator, said absorber being adapted to absorb into the solvent the refrigerant evaporated by said evaporator, and said generator being adapted for evaporating, due to the thermal input from the outside, the refrigerant absorbed in the solvent in said absorber, characterized in that a refrigerant reservoir with condensed refrigerant liquid stored therein is disposed between said condenser and said expansion valve, and the operation of said compressor is controlled by the liquid level of said refrigerant reservoir. Also, in the preferred embodiment of the present invention, there is provided an absorption type refrigerating machine of hybrid construction wherein said refrigerant reservoir has a liquid level detector therein, which is adapted to detect the top-limit liquid level and the bottom-limit liquid level, said compressor being driven at the bottom-limit liquid level and its operation being stopped at the top-limit liquid level.

These and other objects, features, aspects and advantages of the present invention will become more apparent from the following detailed description of the present invention when taken in conjunction with the accompanying drawing in which;

The FIGURE is a diagram partially in cross-section showing an arrangement of an absorption type refrigerating machine having hybrid construction according to the present invention.

Referring to the FIGURE, there is shown a refrigerating machine of absorption type with a hybrid construction comprising a refrigerant vapor generator 1, compressor 3, condenser 4, refrigerant reservoir 5, expansion valve 6, evaporator 7, mixer 8, heat-exchanger 9, absorber 10, pump 11, and pipe lines for connecting the above components in order to form a closed circuit of an absorption type refrigerating cycle. The refrigerant vapor generator 1 is an absorption type having a well known construction to produce the refrigerant vapor from refrigerant solvent therein by means of the thermal input to be fed from the outside from the solar heat, waste heat or other heat sources in a known manner. As the refrigerants used here, refrigerants of higher vapor-pressure such as ammonia, Freon gas, etc. are effective to make the compressor for the refrigerant vapor smaller in size. Also, a solvent which dissolves the refrigerant effectively and is less volatile to use is preferred to use within the refrigerant vapor generator 1. Water is used when the refrigerant is ammonia and organic solvents such as tetraethylene glycol dimethyl ether, etc. are used when the refrigerant is one of the Freon series.

The refrigerant vapor produced at the generator 1 passes through a passage 2 into the compressor 3. When the compressor 3 is in its inoperative condition, the refrigerant vapor merely passes through the compressor 3 into the condenser 4 where the refrigerant vapor condenses into liquefied refrigerant, which passes, in turn, through the refrigerant reservoir 5 and the expansion valve 6 into the evaporator 7 wherein the liquefied refrigerant is again evaporated to effect the heat-exchanging operation for the cooling heat-containing medium introduced to the outside of the evaporator 7. The refrigerant vapor evaporated in the evaporator 7 goes into the mixer 8 which is connected with the inner pipe 9*a* of the heat exchanger 9 and the absorber 10 connected with the outer pipe 9*b* of the heat exchanger 9 through the pump 11, said inner and outer pipes of the heat exchanger 9 being connected the refrigerant vapor generator 1, respectively. The solvent, the refrigerant content of which has been reduced at the generator 1, i.e., refrigerant poor solution flows into the mixer 8 through the inner pipe 9*a* of the heat-exchanger 9 to mix with the refrigerant vapor coming from the evaporator 7. The refrigerant vapor mixed with the solution in the mixer 8 goes together with the solution into the absorber 10 to effect the heat-exchanging operation for the cooling heat medium to be introduced at the outsides and the refrigerant poor solution becomes a refrigerant rich solution. Then, the refrigerant rich solution produced by the absorber 10 is passed through the heat-exchanger 9 by the pump 11 and returns to the generator 1. When the compressor 3 is driven by a driving motor 13, the refrigerant vapor produced at the generator 1 is forcibly supplied into the condenser 4 by the operation of the compressor 3, the driving motor being operated under the control of a refrigerant liquid level detector 12 provided within the refrigerant reservoir 5.

The refrigerant reservoir 5 of the present invention is disposed between the condenser 4 and expansion valve 6. The liquefied refrigerant condensed at the condenser 4 temporarily stays in the refrigerant reservoir 5. The refrigerant liquid level detector 12 is disposed within the refrigerant reservoir 5 to transmit an electric signal for the motor 13 through a line 14, when the refrigerant liquid level has become a given value or more, or less, thereby to drive or stop the motor 13 for driving the compressor 3. The liquid level detector 12 is comprised, for instance, of a combination of a float to be shifted in accordance with the refrigerant liquid level and a plurality of switches each located so as to be operated by the float at a different position. Such a detector 12 mechanically makes and breaks switches by the float as it moves to generate the respective signal for the motor 13. Any other liquid level detector may be employed to detect the refrigerant liquid level by other physical or mechanical means to generate the signal in a known manner. If and when the refrigerant vapor pressure from the passages 2 becomes lower, the condensing operation is no longer effected in the condenser 4 with the consequence that the production of the refrigerant liquid in the condenser 4 and the consumption thereof in the evaporator 7 are put out of balance, thus lowering the refrigerant liquid level inside the refrigerant reservoir 5.

The liquid level detector 12 detects the lowered refrigerant liquid level inside the refrigerant reservoir 5 and transmit an electric signal to the motor 13 which has a compressor power supply circuit. Then, the compressor 3 starts its operation to supplement the refrigerant liquid supplied to the condenser 4.

When the refrigerant liquid level is returned to a given level within the refrigerant reservoir 5, the compressor 3 comes to a stop by the operation of the liquid level detector 12.

When the one liquid level as a control reference is established for the liquid level detector 12, the compressor 3 is frequently driven and stopped according to the changing of the liquid level. Thus, it is effective to set two levels for the liquid within the refrigerant reservoir 5, one being a top limit level (a) for stopping the operation of the detector 12, the other one being a bottom limit level (b) for starting the operation thereof in a known manner. For instance, the switches to be operated by the float are respectively provided at the top limit level (a) and the bottom limit level (b) to set the two levels for the liquid as mentioned above.

In the refrigerating machine of the present invention, the compressor 3 is adapted to start its operation and stop operation in response to the detector 12 under a condition where the refrigerant liquid produced in the condenser 4 and the refrigerant liquid consumed in the evaporator 7 are always retained in proper balance to remove such dangers for the reservoir 5 as described hereinabove, thus ensuring less electric power consumption for the compressor 3. Although in the adoption of such a conventional controlling system as described hereinabove, the compressor 3 should be provided with a special mechanism or a separate reflux circuit should be provided in the refrigerant circuit as described at the beginning of this specification to remove such dangers as described hereinabove and to prevent the wasteful operation of the compressor 3.

According to the present invention, an ordinary compressor can be used in the refrigerating machine.

According to the present invention, a hybrid type refrigerating machine is composed of a refrigerant vapor generator and an electrically-driven compressor. Through extremely simple detector means, the operation of the compressor is controlled, which is adapted to supplement reduction in the absorption type cycle output caused by the lowered heat supply temperature, etc. The compressor performance controlling operation, which has been considered necessary for the operation of the compressor under the varying suction pressures, as well as the performance control with respect to the load variation in the conventional system has been omitted in the system of the present invention, and the wasteful power consumption for the compressor has been ended. The operation of the refrigerating machine has been endured.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. In an absorption type refrigerating cycle having a refrigerant vapor generator for evaporating, by the application of thermal input from outside, the refrigerant absorbed in the solution in an adsorber which is provided to absorb into the solution the refrigerant evaporated by an evaporator connected through a condenser and an expansion valve to the generator in a refrigerant circuit, a hybrid type refrigerating machine comprising a compressor for compressing the refrigerant vapor and connected between said generator and condenser, a refrigerant reservoir for storing the condensed refrigerant liquid connected between said condenser and expansion valve, and a means for controlling the operation of said compressor in response to the liquid level in said refrigerant reservoir.

2. A hybrid type refrigerating machine as defined in claim 1, wherein said control means comprises a liquid level detector provided in said refrigerant reservoir, said detector being adapted to detect the different liquid levels in said refrigerant reservoir.

3. A hybrid type refrigerating machine as defined in claim 2, wherein said compressor is driven in response to the detection of the bottom limit liquid level of the detector and is stopped in response to the top limit liquid level.

* * * * *